US005295366A

United States Patent [19]

Lopez et al.

[11] Patent Number: 5,295,366

[45] Date of Patent: Mar. 22, 1994

[54] SEALED REFRIGERATION IMMERSION VESSEL

[76] Inventors: Gaudencio Lopez; Raul A. Arroyo; Darrell C. Nugent; Charles B. Lovett, all of 1465 Ellerd Dr., Turlock, Calif. 95380

[21] Appl. No.: 5,447

[22] Filed: Jan. 19, 1993

[51] Int. Cl.[5] ..... F25D 25/04

[52] U.S. Cl. ..... 62/266; 62/374; 62/380

[58] Field of Search ..... 62/63, 266, 374, 375, 62/380

[56] References Cited

U.S. PATENT DOCUMENTS

| | | | |
|---|---|---|---|
| 3,214,928 | 11/1965 | Oberdorfer | 62/63 |
| 3,300,993 | 1/1967 | Schlemmer | 62/63 |
| 3,304,732 | 2/1967 | Rubin | 62/380 X |
| 4,073,158 | 2/1978 | Guiller | 62/266 |
| 4,499,740 | 2/1985 | Older et al. | 62/374 |
| 4,528,819 | 7/1985 | Klee | 62/63 |

*Primary Examiner*—William E. Tapolcai
*Attorney, Agent, or Firm*—Basil Travis

[57] ABSTRACT

A refrigeration immersion vessel primarily designed for direct immersion of comestibles into liquid chlorofluorocarbons (CFC's) at approximate minus 20 degrees Fahrenheit is described wherein said vessel employs pairs of rotary vane valves with internal vacuum in communication with a closed system to recycle CFC vapors into said vessel while preventing atmospheric air from entering it, said vessel further utilizing different CFC from a source external of the vessel and of lower boiling point to maintain temperature of vessel reservoir refrigerant, said vessel also having condensers using the external CFC refrigerant for recondensing internal CFC vapors, controlling vessel reservoir temperature and temperature of vessel refrigerant storage outside said vessel, said vessel further comprising an inclined internal conveyor means and bottom for drainage by gravity of excess refrigerant into its reservoir.

7 Claims, 3 Drawing Sheets

SEALED REFRIGERATION IMMERSION VESSEL

BACKGROUND OF THE INVENTION

1. Field of the Invention

The present invention relates to so-called "quick freezing" of solid materials, mainly comestibles, by direct immersion in a liquid refrigerant contained in a sealed vessel.

More specifically, the present invention deals with refrigeration immersion vessels having within their structures an elongated tunnel with movably inclined conveyor means by which solid materials are briefly conveyed through a fluid refrigerant bath of approximately minus 20 degrees Fahrenheit, while allowing no escape of refrigerant vapors from neither the vessel nor the product itself.

2. Discussion of the Prior Art

As it is perhaps well known, there are many diverse commercial, scientific and industrial applications where it is desirable to rapidly freeze materials by directly contacting them with cryogenic or refrigerant fluids, spray or vapors. In virtually all such known applications the material is essentially conveyed through an insulated tunnel of a vessel containing a preferred liquid cryogen or refrigerant, the choice of which largely being dependent on its operating temperature and the speed and degree of freezing desired.

Cryogenic fluids, such as liquid nitrogen, liquid air and liquid carbon dioxide have normal boiling points substantially below minus 100 degrees Fahrenheit, while common refrigerant fluids, such as liquid ammonia and the chlorofluorocarbons (CFC's), have boiling points above minus 100 degrees Fahrenheit and are normally utilized in the temperature range of about −20 degrees F.

In either case, however, the prior art recognizes but fails to solve a major problem of vapor containment within the various vessels as materials are treated therein or, more importantly, from the treated products themselves. Where cryogenic fluids are utilized, it is not environmentally important to contain all of the vapors, but where common refrigerants are used, it is essential that none of their vapors escape into the earth's atmosphere.

Therein lies the distinction and what is believed to be an improvement of the present invention over the prior art.

For example, in U.S. Pat. No. 3,718,284 (1973), Richardson discloses an apparatus and process for embrittling whole used automobile tires prior to crushing and grinding for recycling. This method and apparatus is typical of direct immersion art using cryogenic fluids such as liquid nitrogen, liquid carbon dioxide and liquid air, however such art does not necessarily address containment of vapors from the treated products.

A similar prior art problem of vapor containment is seen in the direct immersion of materials into FREON fluorocarbons (CFC's) as described in U.S. Pat. Nos. 3,440,831 (1969) and 3,774,524 (1973). Although the 1990 Amendments to the Clean Air Act (Title 42, United States Code, Section 7400, et.seq.) require a complete ban on using Class I CFC's by year 2000 (and Class II CFC's by the year 2030), chlorofluorocarbons and, especially CFC-12, are presently in wide use as refrigerants in many commercial applications and dichlorodifluoromethane is presently the liquid refrigerant of choice for direct immersion of comestibles because it is nontoxic, non-corrosive, colorless, odorless, nonflammable and has a boiling point of about −22 degrees Fahrenheit, all of which produces many desired results in a variety of food processing applications. For example, comestibles immersed in liquid dichlorodifluoromethane for a period of time do not stick together and have longer shelf life due to quick freezing which is known to kill bacteria. Thus, it can be easily seen that the utilization of CFC's in food processing alone has several advantages not attainable with cryogenic liquids.

Because of concerns over CFC's damage to the earth's ozone shield that screens out the sun's harmful ultraviolet rays, forty-seven countries in September 1987 agreed to the provisions of the Montreal Protocol on Substances that Deplete the Ozone Layer calling for a ban on consumption of selected CFC's and a 50 percent reduction of them by year 1999. Nonetheless, liquid CFC's are still in wide use and preferred for direct immersion of a variety of materials because of their desirable qualities.

Heretofore, however, there were no suitable immersion vessels specifically designed to contain CFC vapors as pointed out in the prior art.

First, several problem were known with sealing the entrances and exits of these vessels as materials moved in and out of them as thoroughly discussed in U.S. Pat. No. 4,175,396 (1979).

Secondly, there has also been described a persistent problem of re-condensing the voluminous gas produced as vapor in a vessel when a material at ambient temperature was immersed into a cryogenic or refrigerant bath held just below its boiling point, as discussed in U.S. Pat. Nos. 3,768,272 (1973) and 4,928,492 (1990).

Third, known immersion vessels did not specifically address the problem of cryogenic or refrigerant vapors escaping from treated materials after they exited the vessel.

These problems are addressed and solved in the present invention.

SUMMARY OF THE INVENTION

The refrigeration immersion vessel of the present invention is specifically designed to rapidly freeze a variety of materials, especially comestibles, by direct immersion in a liquid bath of CFC's, preferably dichlorodifluoromethane, while preventing any release of CFC vapor into the earth's environment from either the vessel or the treated products.

The vessel may be spatially described as an insulated and sealed horizontally oblong container or tank with entrance and exit ports through which solid materials enter the vessel by way of rotary vane valves as described in detail in previous U.S. Pat. application Ser. No. 07/948,642, filed Sep. 23, 1992, entitled Vapor Locking Rotary Vane Valve For Refrigeration Immersion Vessels, but shall be furthermore described herein.

The interior of the vessel in relation to its horizontal and vertical planes has preferably a lower reservoir directly under its entrance port which contains liquid CFC refrigerant and into which materials are dropped by gravity through a rotary vane valve for quick freezing.

Extending longitudinally from the reservoir and entrance port is an essentially cross-sectionally inverted "U" shaped overhead tunnel with inclined base terminating in an exit port affixed with another rotary vane valve, connected in reverse as the aforesaid entrance valve, for egress of frozen materials free from CFC vapors.

To accomplish movement of solid materials through the vessel's interior, there is preferably positioned a rotatable linear auger, with one end seated near the bottom of the reservoir immersed in liquid refrigerant, but inclined upwardly diagonally and suspended within said tunnel into its upper exit end and terminating directly above the exit port.

Because of the varying densities of materials to be frozen with respect to the density of liquid refrigerant in the reservoir, a shroud is provided partially over the auger forwardly inclined below the entrance port and just above the reservoir refrigerant to trap those materials which would otherwise float between the shroud and auger blades as the auger turns thereby advancing the materials out of the bath and through the tunnel.

A casing of essentially vertical cross-sectional "U" shape longitudinally surrounds very closely, but not in contact with, the entire lower length of the auger thereby providing no escape of solid materials from the auger blades as they capture, submerge and advance said materials through the vessel. The open top of the casing, aside from the shroud, allows escape of vapors from the treated materials while its inclined position provides drainage of liquid refrigerant back into the reservoir.

Condensers, preferably horizontally and linearly mounted above the auger and reservoir, but forward of the entrance port, extend about midway through the vessel thereby providing a means for re-condensing refrigerant vapors from the reservoir and the treated materials. These condensers are internally supplied with another liquid refrigerant from a source external of the vessel, said condenser refrigerant having a lower boiling point that the reservoir refrigerant.

A refrigerant storage tank is also provided externally of the vessel with plumbing connection to vessel reservoir for emptying or filling the vessel reservoir, said plumbing also having a separate heat exchange means in communication with the condenser refrigerant to maintain said reservoir refrigerant below its boiling point.

DESCRIPTION OF THE PREFERRED EMBODIMENT

Before turning to the drawings, it should be briefly pointed out that there is a diversity of opinion as to the extent of harm that CFC's do or do not do to the earth's ozone, as best stated in a recent article entitled "Exposing The Ozone Mythology", HAZMAT WORLD Magazine, Vol. 5, No. 10, October, 1992, pp. 66 to 68. Therefore, the presentation of this invention should not be construed to either endorse nor advocate the use of CFC's for direct immersion of materials therein for quick freezing, but should be presented within the scope and spirit of compliance with numerous governmental rules and regulations concerning containment of CFC fluids and vapors while also providing an apparatus for their continued and legal utilization.

Figure 1:
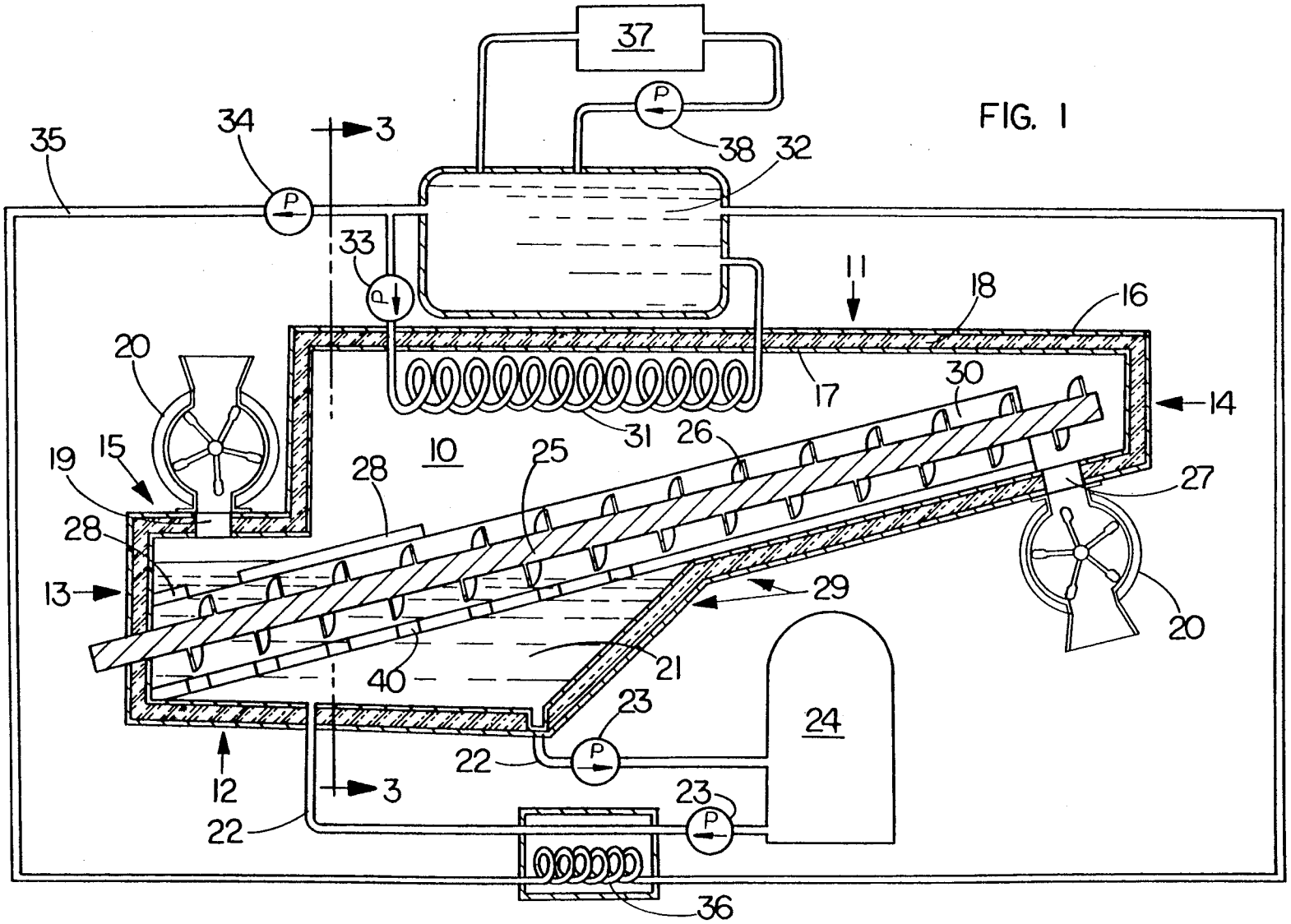
FIG. 1 is a cross-sectional side elevational diagrammatical schematic view illustrating the general shapes of the essential elements and how they are related to each other.

Referring now to FIG. 1 there is a diagrammatically schematic cross-sectional side elevational view of the essential elements of the present invention illustrating their approximate preferred shapes and how they are related to each other, however it should be understood that precise shapes and positing in practice may not be exactly as shown. The vessel 10 itself is preferably of configuration illustrated in FIG. 1 and may spatially described as a horizontally oblong container or tank with horizontal length greater than its maximum vertical height and which may also be described as an elongated tunnel of inverted "U" cross section.

For orientation of FIG. 1, the elongated vessel 10 has a top 11, an entrance end 13 (located at the left of said FIG. 1), and a bottom 12 with inclined base 29 rising diagonally towards an exit end 14. There is also a plateau 15 region of the entrance end 13 about one-half way along its vertical height between said bottom and top.

Figure 3:
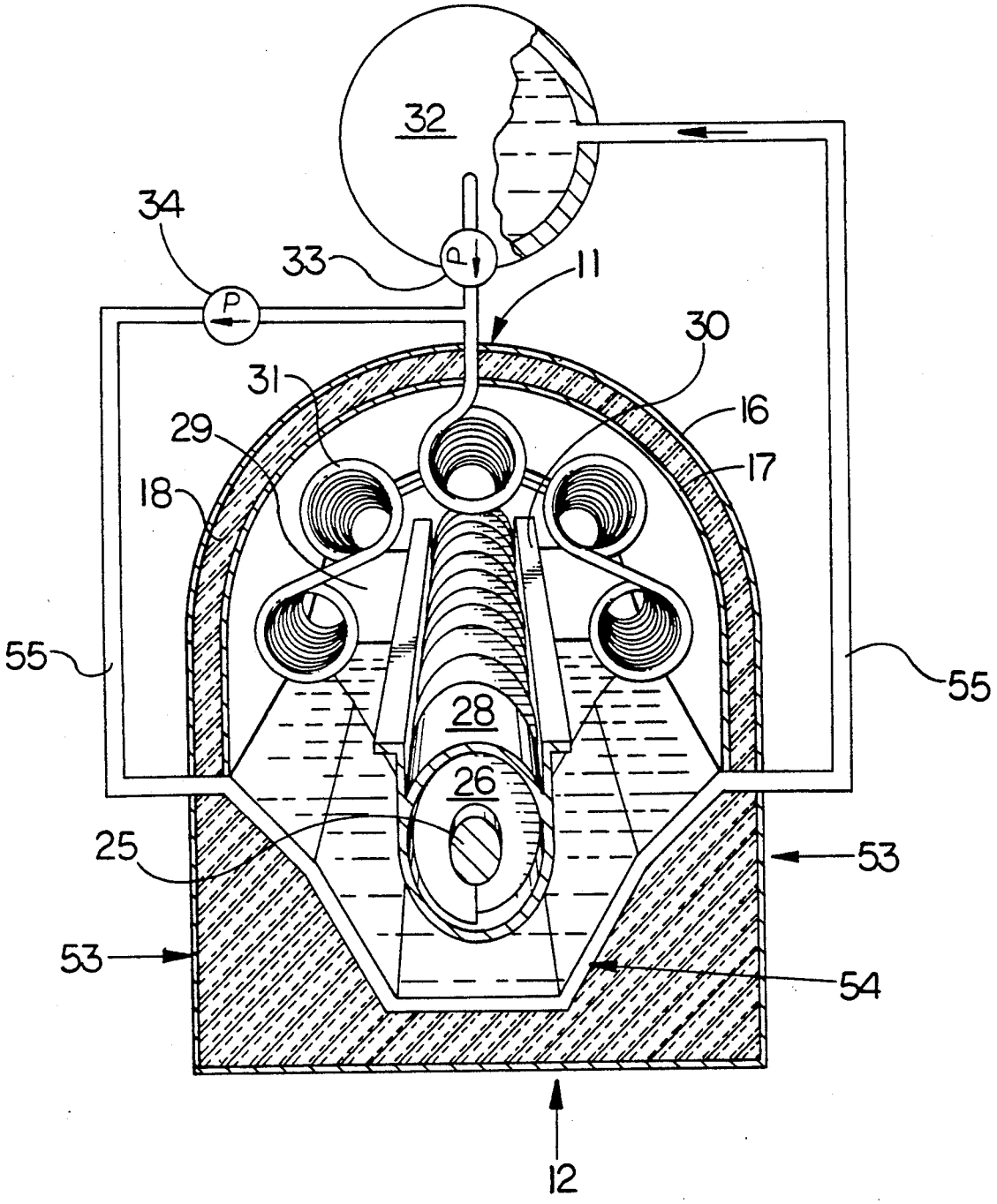
FIG. 3 is a cross-sectional front perspective view taken along lines 3—3 of FIG. 1.

FIG. 3 illustrates a front perspective view taken from the entrance end 13, partially cut away, to show the tunnel shape of said elongated vessel 10 having an inverted "U" configuration.

Having established the spatial orientation of the vessel and returning to FIG. 1, it can be seen that the vessel 10 has an outer wall 16 and inner wall 17, preferably made of stainless steel although other suitable materials may as well be used, said walls separated by insulation 18.

The plateau 15 of the entrance end 13 of the vessel 10, shown in FIG. 1, has an essentially central entrance port 19 connected externally to a rotary vane valve 20 through which materials enter the vessel as shall be described in more detail hereinafter.

Below the entrance port 19 is a reservoir 21, FIG. 1, in the vessel's 10 lower interior base adjacent to the entrance end 13, and shown by broken lines full of liquid refrigerant to its proper working level. The reservoir 21 is connected by plumbing 22, through the bottom 12 of the vessel 10, with pumps 23 to a storage tank 24 to provide a means of emptying and refilling the vessel 10. It should be pointed out that said plumbing 22, pumps 23 and storage tank 24 may or may not be positioned directly underneath said vessel 10 as shown in FIG. 1 in which structural support or legs have been purposely omitted from the vessel 10 for simplicity of illustration.

Inclined upwardly from the vessel's 10 interior reservoir 21 beginning at a proximate area joining the entrance end 13 and bottom 12, is a linear auger 25 of common construction, inclined diagonally with the base 29 and towards the exit end 14 of the vessel, terminating above the vessel's 10 exit port 27, as shown in FIG. 1. As the auger 25 rotates, its blades 26 propel materials through the vessel 10 upwardly with respect to its longitudinal plane and discharge materials by gravity through the exit port 27 into a rotary vane valve 20 for egress from the vessel 10.

Because of the varying densities of materials entering the vessel's 10 reservoir 21 through the entrance port 19, a shroud 28, shown in FIG. 1, partially covers a portion of the auger 25 submerged in liquid refrigerant (broken lines), to trap those less dense materials under the shroud 28 and below the surface of the liquid refrigerant and between the auger 25 blades 26, which would otherwise tend to float, and the positioning of the shroud 28 in the refrigerant ensures uniform immersion of materials which has been a persistent problem discussed in the prior art.

Although the auger 25 and shroud 28 combination used for submerging materials in a liquid refrigerant is preferred in this embodiment, it should be understood that other immersing and conveying means are known in the art, such as baskets mounted on conveyor chains, which could easily be utilized in the vessel 10 of the present invention, however it is believed that the use of an auger is an improvement due to its simplicity and reduced maintenance requirements because of fewer moving mechanical parts.

To enable advancement of treated materials through the vessel 10 as they exit the reservoir's 21 liquid refrigerant between the blades 26 of the auger 25, a longitudinally elongated casing 30 of essentially vertical cross-sectional "U" shape preferably surrounds very closely, but not in contact with, the entire linear length of the auger 25, as partially shown in both FIGS. 1 and 3, thereby preventing escape of said materials from below and from the sides of rotating auger 25 blades 26 as they capture, submerge and advance the materials through the vessel 10. The open top of the casing 30, apart from the shroud 28, provides for vaporization of refrigerant vapors from the treated products as they travel upwardly through the vessel 10, while the inclined position of the casing 30 also serves as a trough to collect drainage of liquid refrigerant from the materials for return to the reservoir 21 through a plurality of orifices 40 in that part of casing 30 which lies in the reservoir 21, as illustrated in FIG. 1, although greatly exaggerated in size for the purpose of illustration, but in practice large enough to allow passage of liquid refrigerant through the casing 30 by circulation caused by rotating auger 25 blades 26. This constant mixing of liquid refrigerant is believed another important advantage of the present invention over the prior art which has attempted but has largely failed to provide uniform freezing of materials as thoroughly discussed in U.S. Pat. No. 4,852,358 (1989), but in this preferred embodiment the auger 25 not only provides transport of materials through the refrigerant and the vessel, but also continuously stirs and mixes the liquid refrigerant thereby providing uniform temperature in the reservoir 21 bath.

Refrigerant vapors released into the vessel's 10 interior from both the reservoir 21 and treated products by way of the open top of the casing 30, are recondensed by condensers 31, one of which is schematically shown in FIG. 1, preferably affixed and suspended from the top of the vessel's 10 interior linearly in conformance with the vessel's longitudinal length and arranged in a plurality as best illustrated in FIG. 3 in an inverted "U" configuration conforming to the overall cross-sectional shape of the vessel's 10 top.

These condensers 31, being hollow, are supplied internally with a circulating liquid refrigerant, hereinafter called "condenser refrigerant" (as opposed to reservoir refrigerant), said supply source being external of the vessel 10, preferably from a tank 32 and pump 33 to provide continuous circulation of condenser refrigerant through the condensers 31, said condenser refrigerant being of a lower boiling point (colder) that reservoir refrigerant so that any reservoir refrigerant vapors inside the vessel 10 in contact with said condensers 31 will re-liquefy for return to the reservoir 21. The said lower temperature of the condenser refrigerant is maintained by a common external condensing unit 37 with a pump 38, however they need not be located over the top 11 of the vessel 10, but are only illustrated there for simple schematic explanation of their operation, said external condensing unit 37 and pump 38 being of any type commonly employed with similar freezing apparatus as previously described in prior art U.S. Pat. Nos. 4,073,158 (reference numerals 11 and 12), or 4,928,492 (reference numerals 66 and 70), which are herein incorporated by reference and made a part hereof.

FIG. 1 further illustrates yet another use of the condenser refrigerant from external tank 32. By means of pump 34 and plumbing 35 it is also circulated in proximate contact by a heat exchanger 36 as a means of controlling the temperature of the reservoir refrigerant when filling the vessel 10, which is necessary to keep said reservoir refrigerant below its boiling point and liquefied.

Attached externally at the entrance port 19 and exit port 27 of the vessel, illustrated in FIG. 1, are rotary vane valves 20, described in U.S. patent application Ser. No. 07/948,642, filed Sep. 23, 1992. It is the purpose and function of these valves 20 to not only preventing air from entering the vessel 10, but to also prevent refrigerant vapors from escaping from the vessel 10 or treated products themselves.

Figure 2:
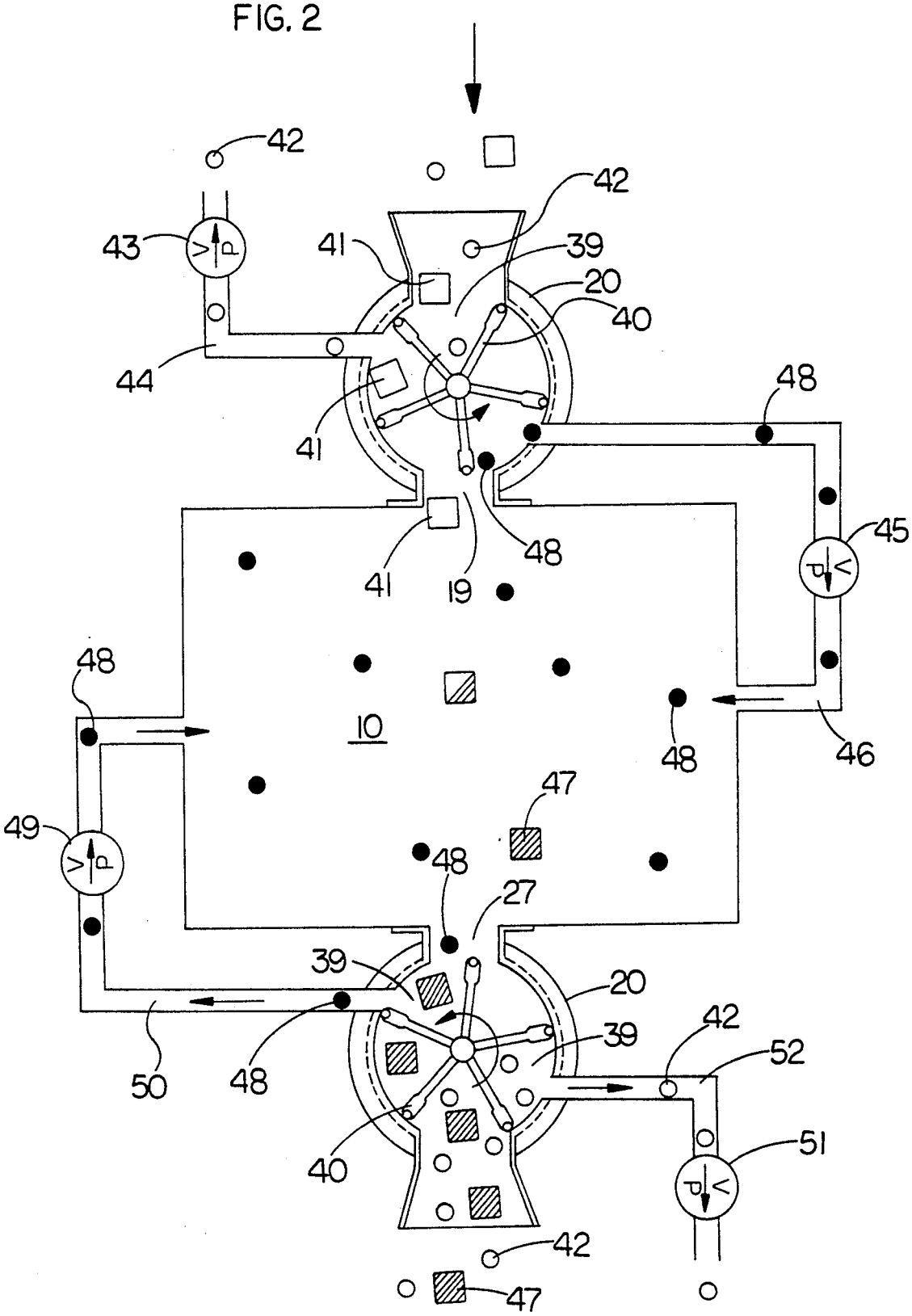
FIG. 2 is a schematic diagram of the rotary vane valve control system not shown in the other figures.

FIG. 2 schematically diagrams how these valves 20 work in a cross-sectional view with vessel 10 shown in the center of the illustration with reservoir refrigerant 48 (vapor or liquid) in black dots. The rotary vane valves 20 shown at top and bottom of FIG. 2 work under high vacuum which evacuates vapor or liquid from a particular rotating chamber 39 between vanes 40 while allowing solid material 41, shown in clear squares, to enter the valve 20, shown at the top of illustration, along with atmospheric air 42, shown in clear circles.

As the vanes 40 rotate counter-clockwise, as shown in top of FIG. 2, the chamber 39 rotates to a position where it is communicates with vacuum produced by a vacuum pump 43 and plumbing 44 thereby removing the air 42 but leaving the solid material 41 to enter the vessel 10 by gravity through the entrance port 19.

However, it can be seen in FIG. 2 that some refrigerant will always naturally diffuse into an open compartment 39 and said compartment must then be evacuated at yet another position by communication with vacuum produced by a vacuum pump 45 and plumbing 46 connected to the vessel 10 for recycling of the refrigerant 48, thereby preventing its escape into the atmosphere.

As treated material 47, shown in solid squares, exit the vessel 10 through exit port 27, some refrigerant vapor 48 will diffuse into chamber 39 and may remain on said material 47 as a residue. The chamber 39 is first rotated to a first position for communication with high vacuum caused by vacuum pump 49 and plumbing 50, (as illustrated in FIG. 2 at bottom and left) connected to the vessel 10 for evacuation of the chamber 39 and recycling of refrigerant back into the vessel 10.

As treated material 47 is discharged from the valve 20, as illustrated at the bottom of FIG. 2, atmospheric air 42 will once again naturally diffuse into a compartment 39 and is subsequently evacuated therefrom as said compartment is further rotated into vacuum communication with pump 51 and plumbing 52, which prevents air from entering the vessel 10 through the exit port 27.

To those skilled in the art it may be obvious that four vacuum pumps 43, 45, 49 and 51 are not necessary for the operation of the valves 20, if plumbing 44, 46, 50 &

52 would have been shown more efficiently combined, for example by way of a manifold. However, it should be recognized that FIG. 2 schematic is presented for ease of understanding the principle of the valves operation and not as a plumbing diagram.

Referring now to FIG. 3, a cross-sectional front perspective view taken along lines 3—3 of FIG. 1, there are seen the essentially vertical sides 53 of the vessel 10 with dome-shaped top 11, comprising in inverted "U" shape with a flat bottom 12, all of which having the appearance of a tunnel as previously stated. Insulation 18 is shown in diagonal lines between the outer wall 16 and inner wall 17, and a preferred positioning of a plurality of condensers 31, are schematically illustrated interconnected to each other for internal circulation of condenser refrigerant supplied externally from tank 32 pump 33 through the vessel's 10 dome 11, however it should be emphasized once again that positioning of said tank 32 and pump 33 on top 11 of the dome are for purposes of schematic illustration only and for ease of understanding operation of condensing and keeping cold the vessel's reservoir refrigerant by external and colder condenser refrigerant, and in actual practice said tank 32 and pump 33 are not located on top of the vessel 10.

One further purpose of the condenser refrigerant, illustrated in FIG. 3 and not in the other figures, is its circulation by pump 34 and appropriate plumbing 55 through a heat transfer plate 54 lining the bottom of reservoir 21 thereby keeping the reservoir refrigerant cold.

Also shown in FIG. 3 is the preferred position of the auger 25, portion of the shroud 28 and auger blades 26 partially enclosed in its casing 30, all of which are perspectively inclined from the reservoir 21 upwardly along the inclined base 29 of the tunnel toward its exit end 14, shown in FIG. 1.

Having described our invention in detail, we claim:

1. An apparatus for rapidly freezing solid materials by direct immersion into liquid refrigerants, said apparatus comprising in combination:

a. a sealed elongated vessel of generally cross-sectional inverted "U" configuration, having a horizontally linear top, essentially vertical sides, entrance and exit ends, a bottom with inclined base rising diagonally towards its exit end, a plateau region of said entrance end;

b. an entrance port in said plateau region through which solid materials enter said vessel by gravity;

c. a reservoir located in the vessel's interior bottom beneath the entrance port for containing liquid refrigerant into which the solid materials fall;

d. a linear auger, with auger blades, diagonally inclined upwardly parallel with the vessel's inclined base, the lower end of said auger positioned near the bottom of said reservoir within liquid refrigerant and beneath said entrance port;

e. a shroud covering a top portion of said auger blades positioned in the reservoir to trap and immerse less dense solid materials between said blades which would otherwise float in the liquid refrigerant;

f. a casing of cross-sectional "U" configuration but longitudinally linear surrounding but not in direct contact with linear sides and bottom of said auger blades, but not its linear top thereby allowing vaporization of refrigerant vapors into said vessel while partially enclosing and providing a channel for solid materials as they are advanced through the vessel by rotating auger blades while also providing a means for draining excess liquid refrigerant from the solid materials into the vessel's reservoir;

g. condensers in the vessel's upper interior for recondensing refrigerant vapors in the vessel, said condensers having hollow interior structures being supplied by a source external from the vessel with a liquid refrigerant of lower boiling point than the liquid refrigerant in the vessel's reservoir;

h. an exit port positioned in said inclined vessel bottom for discharging through which by gravity solid materials from said casing and auger blades into a rotary vane valve;

i. rotary vane valves, one connected externally to the entrance port and one connected externally to the exit port, for respectively receiving into and discharging from said vessel solid materials, said valves employing a means for preventing escape of refrigerant vapors from the vessel nor allowing atmospheric air into the vessel;

j. means in external communication with the reservoir of the vessel for filling, draining, storing and maintaining the temperature of the vessel's liquid refrigerant;

k. means for maintaining the temperature of liquid refrigerant in the vessel's reservoir at approximate minus 20 degrees Fahrenheit.

2. The apparatus of claim 1 wherein the means for maintaining the temperature of liquid refrigerant in the vessel's reservoir is a heat transfer plate therein but utilizing liquid refrigerant of lower boiling point than that of said vessel refrigerant;

3. The apparatus of claim 1 wherein the means for filling, draining, and storing liquid refrigerant from the vessel is plumbing in communication between said vessel's reservoir and an external storage tank.

4. The apparatus of claim 1 wherein the means of maintaining the temperature of vessel refrigerant removed from the reservoir is a heat exchanger in contact with said vessel's plumbing, said heat exchanger utilizing liquid refrigerant of lower boiling point than vessel refrigerant.

5. The apparatus of claim 1 wherein the liquid refrigerants are chlorofluorohydrocarbons.

6. The apparatus of claim 1 wherein solid materials treated in the vessel are comestibles.

7. The apparatus of claim 1 wherein the means employed by rotary vane valves to recycle vapors into their atmospheres of origin is vacuum.

* * * * *